US006161411A

United States Patent [19]

Böcking

[11] Patent Number: 6,161,411

[45] Date of Patent: Dec. 19, 2000

[54] FINISHING SECTION OF A SINGLE-STRAND WIRE ROLLING TRAIN

[75] Inventor: Reinhard Böcking, Kreuztal, Germany

[73] Assignee: SMS Schloemann-Siemag Aktiengesellschaft, Düsseldorf, Germany

[21] Appl. No.: 09/359,955

[22] Filed: Jul. 22, 1999

[30] Foreign Application Priority Data

Jul. 24, 1998 [DE] Germany ..... 198 33 505

[51] Int. Cl.[7] ..... B21B 41/04; B21B 41/00

[52] U.S. Cl. ..... 72/228; 72/227

[58] Field of Search ..... 72/227, 228, 231, 72/233, 234, 226

[56] References Cited

U.S. PATENT DOCUMENTS 4,182,148 1/1980 Gilvar ..... 72/228

FOREIGN PATENT DOCUMENTS 0606966 9/1997 European Pat. Off. .

*Primary Examiner*—Rodney A. Butler

*Attorney, Agent, or Firm*—Friedrich Kueffner

[57] ABSTRACT

A finishing section of a single-strand wire rolling train with two finishing blocks, wherein, for selectively rolling smaller and larger wire diameters, one of the finishing blocks is arranged in a first rolling line extending in the rolling line of the intermediate rolling section of the train and the other finishing block is arranged in a second rolling line extending parallel to the first rolling line, wherein the wire strand arriving from the intermediate rolling section is selectively supplied to one of the finishing blocks through a distributing guide unit arranged following the intermediate rolling section and the wire strand is conducted after rolling possibly over an additional distributing guide unit to a wire collecting unit arranged following the additional distributing guide unit. A finishing block intended for rolling only small wire diameters is arranged in one of the rolling lines and a finishing block intended for rolling only large wire diameters is arranged in the other rolling line.

1 Claim, 1 Drawing Sheet

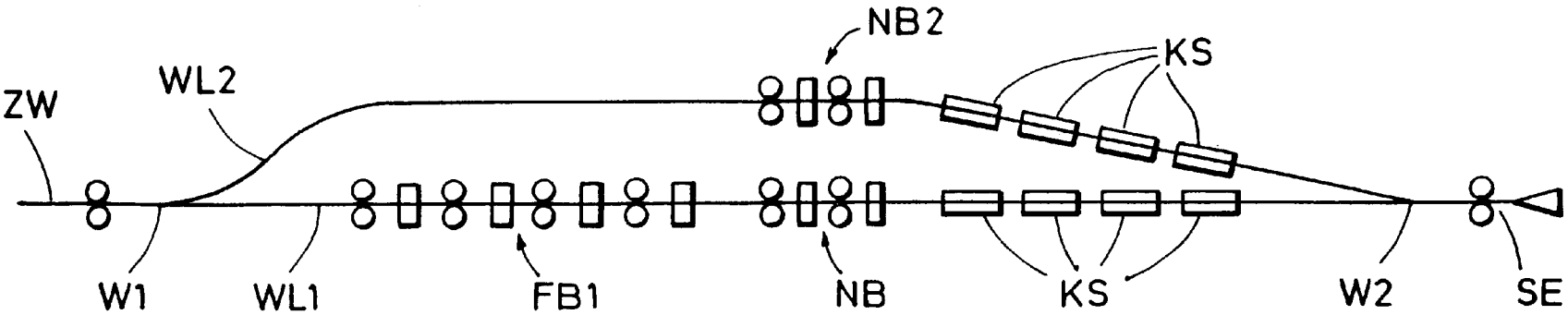
SE
W2
KS
KS
NB2
NB
FB1
WL1
WL2
W1
ZW

FINISHING SECTION OF A SINGLE-STRAND WIRE ROLLING TRAIN

BACKGROUND OF THE INVENTION

1. Field of the Invention

The present invention relates to a finishing section of a single-strand wire rolling train with two finishing blocks, wherein, for selectively rolling smaller and larger wire diameters, one of the finishing blocks is arranged in a first rolling line extending in the rolling line of the intermediate rolling section of the train and the other finishing block is arranged in a second rolling line extending parallel to the first rolling line, wherein the wire strand arriving from the intermediate rolling section is selectively supplied to one of the finishing blocks through a distributing guide unit arranged following the intermediate rolling section and the wire strand is conducted after rolling possibly over an additional distributing guide unit to a wire collecting unit arranged following the additional distributing guide unit.

2. Description of the Related Art

A wire rolling train with a finishing section of the above-described type disclosed in EP 0 606 966 B1, includes, in addition to the distributing guide unit arranged in front of the two parallel rolling lines, following this distributing guide means in the parallel first rolling line the first finishing block and a transfer guide unit for guiding the wire to an entry guide unit in the second rolling line, wherein, following the transfer guide unit and the entry guide unit, the finishing block is arranged in this second rolling line. A finishing section configured in this manner makes it possible, depending on the smaller or larger diameters of the rolled wire, to selectively use the first finishing block in one rolling line or the second finishing block in the other rolling line, or to use both finishing blocks successively by guiding the wire strand from the one rolling line into the other rolling line; however, this configuration requires the mentioned additional guide units for guiding the rolled wire.

In addition, when switching from smaller diameters to larger diameters and vice versa, reassembly operations are required at least at parts of the wire guide units and any cooling stretches. The previously used concept according to the above-mentioned EP 0 606 966 B1 does not make it possible, after switching from a small wire diameter to a larger wire diameter, to once again switch back to small wire diameters without requiring a corresponding reassembly of the wire train. Consequently, every second cycle results in an undesirable stoppage of the train due to reassembly operations. These requirements result in substantial structural and maintenance operations. Moreover, the distributing guide units and the intermediate guide units are susceptible to trouble.

SUMMARY OF THE INVENTION

Therefore, it is the primary object of the present invention to reduce the structural requirements and to simplify the maintenance operations and to render the plant less susceptible to trouble.

In accordance with the present invention, a finishing block intended for rolling only small wire diameters is arranged in one of the rolling lines and a finishing block intended for rolling only large wire diameters is arranged in the other rolling line.

The finishing block intended for rolling the small wire diameters may be composed of successively arranged roughing blocks and sizing or skin pass blocks which are each individually driven, and the finishing block intended for rolling larger wire diameters may be composed of only one sizing block or skin pass block.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic top view of a finishing section according to the present invention for a wire rolling train.

DESCRIPTION OF THE PREFERRED EMBODIMENTS

Arranged following the exit of an intermediate section ZW of the rolling train is arranged a distributing guide unit W1 which leads in the rolling line of the intermediate section into a first rolling line WL1 and, branching off from the rolling line of the intermediate section, into a rolling line WL2. Both rolling lines WL1 and WL2 extend parallel to each other and are joined again by a second distributing guide means W2 and lead into a rolled wire collecting unit SE. Arranged in the rolling line WL1 are a first finishing block FB1 and immediately following the finishing block FB1 a sizing block or skin pass block NB1; the rolling line WL1 further includes a number of cooling stretches KS following the sizing block or skin pass block NB1 and in front of the distributing guide unit W2.

The rolling line WL2 only includes a group of stands NB2 which correspond to the sizing block or skin pass block NB1, wherein the blocks NB1 and NB2 are arranged on the same level. Following the stand group NB2, the rolling line WL2 also includes several cooling stretches KS in front of the distributing guide unit W2. The finishing block FB1, the sizing block NB1 and the stand group NB2 each have individual drives, not illustrated.

The finishing section illustrated in the drawing is operated in such a way that smaller wire diameters are rolled only in the rolling line WL1 and larger wire diameters are rolled only in the rolling line WL2. The cooling stretches KS include guide tubes which in the rolling line WL1 correspond to the smaller wire diameter to be rolled in this rolling line and in the rolling line WL2 the guide tubes correspond to the larger diameters.

The two rolling lines WL1 and WL2 are advantageously operated alternatingly. For example, after the rolling rings for rolling smaller diameters in the rolling line WL1 are worn, this rolling line is stopped and operation of the rolling line WL2 is then started for rolling larger diameters; during this time, maintenance operations are carried out on the roll stands of the rolling line 1 and these roll stands are equipped with new rolling rings. An exchange of the guide tubes in the cooling stretches is not required.

While specific embodiments of the invention have been shown and described in detail to illustrate the inventive principles, it will be understood that the invention may be embodied otherwise without departing from such principles.

I claim:

1. A finishing section of a single-strand. wire rolling train with an intermediate section and a wire collecting unit, the finishing section comprising a first finishing block arranged in a first rolling line extending in a rolling line of the intermediate section of the train and a second finishing block arranged in a second rolling line extending parallel to the first rolling line, a first distributing guide means for selectively guiding a wire strand arriving form the intermediate section to one of the first and second rolling lines and a second distributing guide means for guiding the wire strand from the first and second rolling lines to the wire collecting unit, wherein the first finishing block in the first rolling line is a finishing block for rolling only smaller wire diameters and the second finishing block in the second rolling line is a finishing block for rolling only larger wire diameters, wherein the first finishing block is comprised of a roughing block and a sizing block arranged successively in the first rolling line, wherein the roughing block and the sizing block are provided with individual drives, and wherein the second finishing block for rolling larger wire diameters is comprised of a sizing block.

* * * * *